US007152668B2

(12) United States Patent
Hoffmann et al.

(10) Patent No.: US 7,152,668 B2
(45) Date of Patent: Dec. 26, 2006

(54) HEAT EXCHANGER FOR VEHICLES

(75) Inventors: Hanskarl Hoffmann, Köln (DE); Jörn Fröhling, Köln (DE); Dragi Antonijevic, Köln (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 53 days.

(21) Appl. No.: 11/031,665

(22) Filed: Jan. 7, 2005

(65) Prior Publication Data

US 2005/0161200 A1 Jul. 28, 2005

(30) Foreign Application Priority Data

Jan. 8, 2004 (DE) ..... 10 2004 002 252

(51) Int. Cl.
*F28D 1/04* (2006.01)

(52) U.S. Cl. ..... 165/110; 165/153; 165/174

(58) Field of Classification Search ..... 165/152, 165/153, 173–176, 110
See application file for complete search history.

(56) References Cited

U.S. PATENT DOCUMENTS 3,993,126 A * 11/1976 Taylor ..... 165/173
4,381,033 A 4/1983 Woodhull, Jr. et al.
5,236,044 A * 8/1993 Nagasaka et al. ..... 165/176
5,590,710 A * 1/1997 Sasaki et al. ..... 165/173
5,605,191 A * 2/1997 Eto et al. ..... 165/176
5,806,587 A 9/1998 Sasaki et al.
6,082,448 A 7/2000 Haussmann
6,176,303 B1 * 1/2001 Kobayashi et al. ..... 165/175
6,223,812 B1 5/2001 Gough
6,289,585 B1 * 9/2001 Staruszkiewicz ..... 165/173
6,745,827 B1 * 6/2004 Lee et al. ..... 165/144
6,854,511 B1 * 2/2005 Kitazaki ..... 165/110
2004/0050540 A1 * 3/2004 Kato et al. ..... 165/153

* cited by examiner

*Primary Examiner*—Teresa J. Walberg
(74) *Attorney, Agent, or Firm*—Brinks Hofer Gilson & Lione

(57) ABSTRACT

The invention relates to a heat exchanger for vehicles. The heat exchanger includes a core provided with a row of spaced heat exchanger tubes, open at their ends, and at least one dosed container arranged in the tube end regions for the distribution of a medium flowing through the heat exchanger tubes. Each container includes a tube holding element and a container closure element, connected to each other in a sealed manner. The heat exchanger tubes are put through the tube holding element, connected to it and form spaces between each other. The container closure element is rigidly connected to at least one associated container comb, the teeth of which extend toward the heat exchanger core and are located within the container-interior at the spaces between the heat exchanger tubes and are in rigid connection to at least the tube holding element.

33 Claims, 5 Drawing Sheets

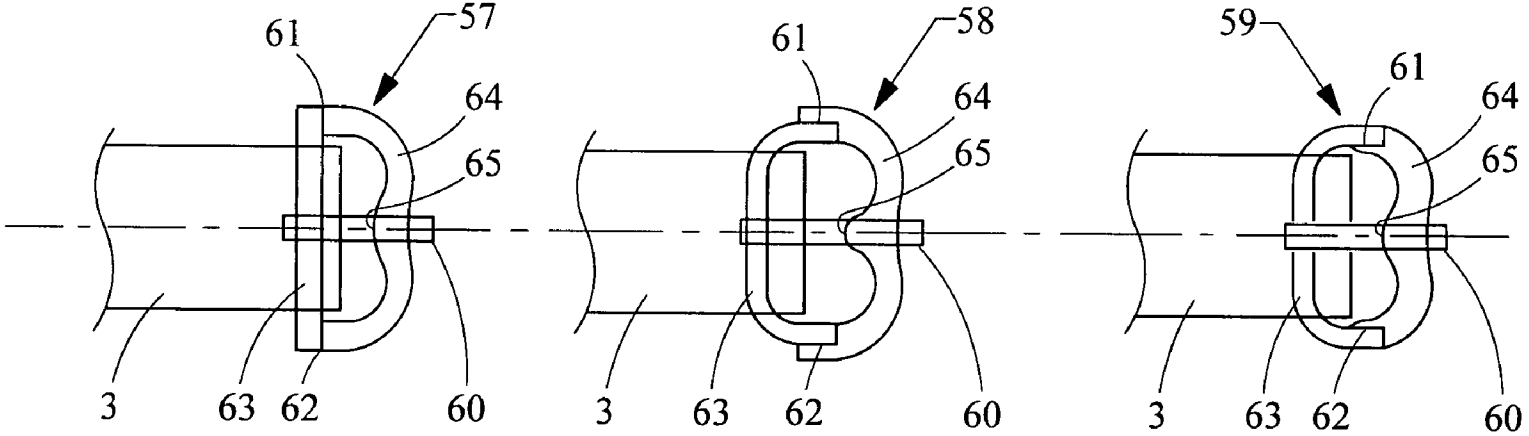
Fig. 7A
Fig. 7B
Fig. 7C
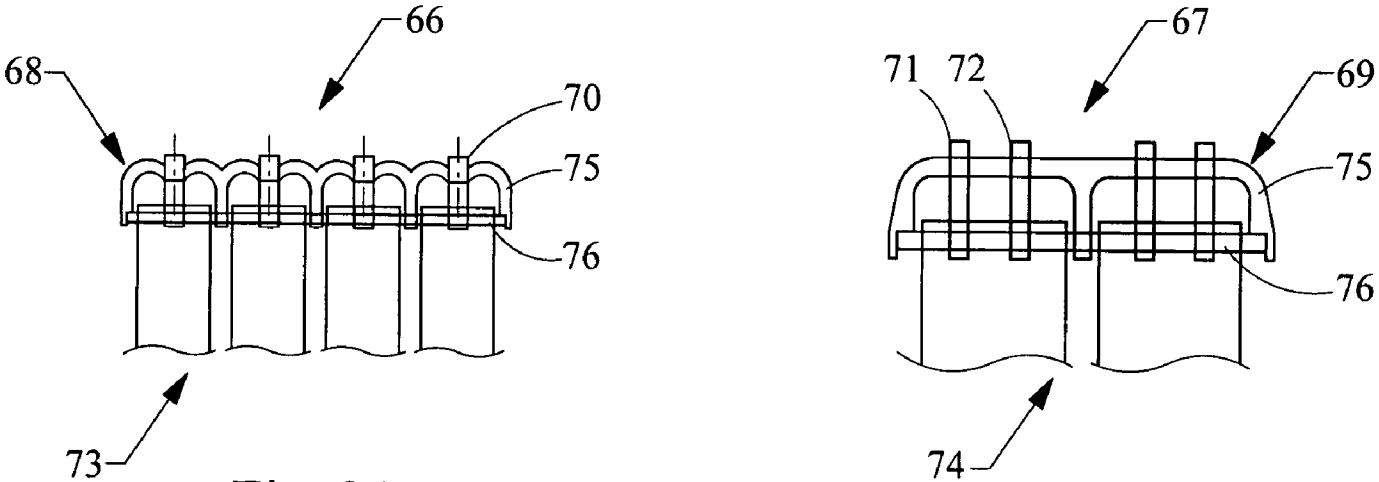
Fig. 8A
Fig. 8B

HEAT EXCHANGER FOR VEHICLES

BACKGROUND OF THE INVENTION

1. Field of the Invention

The invention relates to a heat exchanger for vehicles. The heat exchanger has a heat exchanger core provided with a row of distanced heat exchanger tubes open at their ends and at least one dosed container, arranged in the tube end regions, for the distribution of a medium flowing through the heat exchanger tubes. Each container includes a tube holding element and a container closure element, which are connected to each other in a sealed manner over connection sections, and whereby the heat exchanger tubes are put through the tube holding element, connected to it and form spaces between each other.

2. Related Technology

For a new generation of heat exchangers with an environmentally friendly, yet very efficient refrigerant, particularly based on carbon dioxide at high pressure (R744), the burst pressure requirements of the heat exchanger assemblies, particularly of the two containers, for reasons of safety will rise to more than three times the current amount during the burst test, with a simultaneous rise of the temperature from today's 20° C. to 180° C. (high pressure side) or 120° C. (low pressure side). In order to counteract the burst danger during the present day production of a heat exchanger, particularly of a condenser, the wall thickness of the container closure element and the tube holding element ought to be increased by at least 2 mm.

The heat exchanger tubes contain pressurized flowing media, which can deliver or take up heat, and thus depending on their function are cooling tubes or heating tubes.

The current problems are:

In ratio of the active depth (baffle plate and multiple passage tubes) to the depth of the tube holding element and container closure element, for example, for a 12 mm baffle plate/tube package, approximately double the depth is quoted for the tube holding and container closure elements connected to each other. Due to twice the depth, too much space is required in the vehicle for the heat exchanger.

Because the widely varying material weights in the assembled container it will be difficult to find the suitable brazing conditions which ensure that the entire material will be provided with the proper brazing, temperatures without melting the thinner baffle plates. The range of the brazing parameters is therefore more than critical.

The heavy wall thickness between the different row chambers of the heat exchanger, for example, of an evaporator, results in too wide gaps between the multiple passage tube rows. That leads in this region to long thermal transfer paths from the refrigerant to the passing air. In this region the baffle plate efficiency is relatively low.

Thus the high pressure requirements essentially imply material problems.

As shown in a sectional view in FIG. 6*a* traditional heat exchangers have containers that consist of two elements—a tube holding element and a container closure element. The tube holding element is usually a brazing-plate flat material, which has holes stamped to receive the heat exchanger tubes and is bent in a mold. The container closure element is often an extruded profile. Baffle plates can be provided between the heat exchanger tubes to increase the transfer surface in the heat exchanger core.

A problem of the containers is their structure, whereby heavy wall thickness of the tube holding element and the container closure are necessary, in order to lower the danger of bursting of the containers, to withstand the given medium pressure, particularly a higher burst pressure, or pressure peaks, respectively. Additionally, the wall thickness require relatively big dimensions of the container and hence of the heat exchanger, which therefore demands much space in the vehicle.

A heat exchanger is known from U.S. Pat. No. 3,993,126, where the containers are provided with several single strengthening ribs between the tube holding element and the container closure element. On the other hand, to reinforce the tube holding element a distribution plate made of plastic material is hidingly provided in the region of the tube holding element, whereby the distribution plate is provided with a plurality of insertion holes which are arranged correspondingly with the insertion holes of the tube holding element. High demands of the plastic material exist to establish the container, in order to withstand a high pressure in the container.

A structure of the tube holding element is described in U.S. Pat. No. 4,381,033, where the inner wall of the tube holding element is provided with at least one U-shaped holding element attached to a portion of the rear side to support a baffle wall, which is insertable into the holding element and is in connection with the container closure element. The baffle wall divides the container into an entry chamber and an exit chamber for the coolant. The heat exchanger is provided for the use of traditional coolants. The baffle wall can hardly withstand a higher coolant pressure.

Another heat exchanger is described in U.S. Pat. No. 5,236,044, the containers of which are constructed of the above mentioned elements, where there are engagement holes for dividing baffles to produce container chambers for the deviation of the coolant into the associated heat exchanger tubes and for counterflow passage. The connection section between the tube holding element and the container closure element is the true weak spot, when the container internal pressure is increased. To make the tube holding element withstand the high pressure of the medium flowing in the containers, it is to be provided with extensions of the end regions on the long sides, whereby the extensions are to cover the previous connection sections and be in connection to the container closure elements such that the extensions bear against the rear side of the container closure elements in an overlapping and holding way. A problem with the above is that the overlapping reinforcement is not sufficient to withstand the high pressure of modern medium substances, particularly of a carbon dioxide (R744) flow under pressure.

Another heat exchanger is described in U.S. Pat. No. 5,605,191, the container of which consists of a face plate and a cover. The container volume is divided into two chambers by at least one separating element. The associated face plate has a plurality of put-through holes, through which the heat exchanger tubes are put. Further, the face plate has fit grooves made between the insertion holes for accepting the end sections of the heat exchanger tubes. The heat exchanger tube sections in the end region project into the interior of the container. The separating element is provided with recesses and insertions and, prior to container assembly and brazing, is put on the end sections of the heat exchanger tubes. The insertions are fit in the fit grooves. The rear side of the separating element is to bear against the cover, which is then attached to the tube holding element end regions. A problem is that with a minimum distanced arrangement of the separating element at the inner wall of the cover the container cannot guarantee safety against the high burst pressure requirements, particularly when a highly pressurized medium such as R744 is used.

Another heat exchanger is disclosed in U.S. Pat. No. 5,806,587, where the structure of a container with strengthening plates is described as single metal pieces, separated from each other or as ribs at wide distance, are put in between the tube holding element and the container closure element to reinforce the container. A problem with the above is that the container cannot withstand pressure in case of real high pressure applications with carbon dioxide. In addition, problems may arise during brazing of the plates at the container elements.

A container or collector of a heat exchanger for motor vehicles provided with a chamber division created by crossing flat webs is described in U.S. Pat. No. 6,082,448. The collector consists of a tube bottom, where the heat exchanger tubes are guided, and a dosing cover. The flat webs for the division into chambers have separate holding plug arrangements on both sides to arrange them in the insertion holes of the cover and the tube bottom. The chambers serve to guide and turn back the flowing medium in neighboring heat exchanger tubes. Problems arise due to several complicated processes to braze the elements to each other and when leakages occur in the chambers due to higher pressure of the flowing medium. The chambers are not given with their dimensions related to the increased pressure.

A fluid cooling device is described in U.S. Pat. No. 6,223,812 as a heat exchanger with two containers and heat exchanger tubes arranged as layers between the containers, where each container includes a container wall and a tube insertion wall with a plurality of openings into which the heat exchanger tubes are inserted. At the connection point between the container wall and the tube insertion wall parallel to the tube layers there is a connection batten, from which finger-like projections extend to the outside of the container. The fingers engage between the free distance regions of the layers heat exchanger tubes. The fingers can be connected to both the outside of the tube insertion wall and the outer walls of the heat exchanger tubes and together with the connection batten form an outer comb towards the heat exchanger core strengthening the tube insertion wall. While the normal stability between the tube insertion wall and the inserted heat exchanger tubes is improved, a problem is that an increased pressure in the container can hardly be withstood. The sensitive spot loaded by the inner pressure is the transition region from the container closure element to the connection batten. An operating pressure of only twofold maximum the traditional medium operating pressure can be reached in the chamber in the container.

Another problem of the heat exchangers manufactured to the state-of-the-art is that the integration of the heat exchanger tubes into the tube holding elements is by putting in the heat exchanger tubes into the tube holding elements across the cylinder axis of the tube holding elements or the cylinders established by the collectors/distributors. The heat exchanger tubes therefore deeply project into the cylinder due to the curvature in radial peripheral direction. This raises fluid dynamic problems and strength problems of the heat exchanger in the whole.

SUMMARY

The invention aims at disclosing a heat exchanger for vehicles that is established suitable to improve the stability of the containers in a simple manner, so that bursting at a high operating pressure or at high peak pressures of the passing medium can be prevented. Further the dimensions of the containers are intended to be reduced and material saved. Also, brazing of the units in the region of the containers is to be simplified and made more effective.

The problem is solved by a heat exchanger for vehicles having a heat exchanger core with a row of distanced heat exchanger tubes open at their ends and at least one closed container arranged in the end region for the distribution of a medium flowing through the heat exchanger tubes. Each container includes a tube holding element and a container closure element, which are connected to each other in a sealed manner at connection sections, and whereby the heat exchanger tubes are put through the tube holding element, connected to it and form spaces between each other.

According to the invention the container closure element is rigidly connected to at least one associated container comb, the teeth of which directed towards the heat exchanger core are led into the spaces within the container between the heat exchanger tubes and are in rigid connection at least to the tube holding element.

The tube holding element can, in its cross-section, be rectangular, bent slightly convex or semi-elliptically trough-like and with its convex side turned to the put-through heat exchanger tubes. The container closure element, which corresponds with the tube holding element, can in its cross-section be approximated to an abstracted number three or approximately semi-elliptically trough-like and with its concave side turned to the heat exchanger tubes. Therefore the container, dependent on the configuration of the tube holding element, can have in its cross-section a largely semi-elliptical or elliptical shape.

In the connection sections, which are arranged at the sides opposite to each other, the tube holding element and the container closure element of a container can be brought together partly butting and/or partly overlapping.

In the container closure element, insertion holes are provided at given distances and in series or parallel to the heat exchanger tube layering, particularly put-through holes or through openings, respectively, through which the approximately equally distanced teeth of the respective container comb are put in or through, respectively, from the outside of the container closure element in direction of the heat exchanger core. The insertion cross-section of the insertion holes is adapted to the cross-sectional dimensions of the teeth. In single-row heat exchangers, all insertion holes are positioned preferably centrally in the tube holding element and the container closure element.

If several container combs are used in a container, the container combs can be arranged parallel to the container longitudinal central plane, which, particularly in multiple-row heat exchangers, contributes to stability.

In the container element, a container can optionally be provided with insertion holes, particularly put-through holes or through openings, through which the teeth are put to contact the inner wall of the tube holding element with their end faces. Such a plug-contact connection enhances the strength of the container.

In an extension of the connection there can also be insertion holes, particularly put-in holes or bottoming holes, in the tube holding element starting from the container inner wall, whereby the ends of the teeth of the container are put into the holes.

In another embodiment, a container can also be provided, in its tube holding element, with insertion holes, particularly put-through holes or through openings, which are arranged at given distances in series as well as parallel to the heat exchanger tube layering, with the teeth put in said holes, whereby the ends of the teeth preferably project from the core-directed outer wall surface of the tube holding element or can terminate flush or approximately flush with the outer wall surface. The insertion holes of the container closure element are assigned largely conformal with the insertion holes of the tube holding element. Due to the double plug connection—plug-plug connection—a highly intimate link between the container comb, container closure element and tube holding element comes about.

The end regions of the comb teeth, which project from the outer wall of the tube holding element, can at least be adapted to the put-through holes preferably by bending, arching or twisting, whereby the tube holding element, the container comb and the container closure element are prefixed as a stable unit previous to the final connection process, namely the brazing process.

The comb ridges of the container combs can be outside the containers and bear against the outer wall surfaces of the container closure elements such that the comb teeth are in those regions of the container closure elements that are on the other side relative to the wall.

A container can optionally also be provided with insertion holes, particularly put-in holes or bottoming holes in both the container closure element and the tube holding element and have an inner container double comb the comb batten of which is preferably wall-supported at the inner wall of the container closure element. The container double comb is configured such that on both sides of the comb batten in direction opposite to the heat exchanger core there are tooth-like projections, which are configured, on the one hand, as short teeth for the put-in holes of the container closure element and, on the other hand, as long teeth for the put-in holes of the tube holding element, and in put-in condition, prefix the tube holding element and the container closure element.

Instead of the put-in holes, also put-through holes can be provided in the container closure element as well as in the tube holding element for the teeth adapted in each case, and the comb batten of the container double comb can hear against the inner wall of the container closure element stabilizing the wall in this case too.

The cross-sectional dimensions of the insertion holes in the tube holding elements and in the container closure elements correspond with the dimensions of the teeth, which can optionally have different heights, widths and lengths concerning an element. Preferably insertion holes and teeth are matched to each other correspondingly.

All container combs are in rigid connection to the end faces of the teeth via the brazing material after assembly in positive connection either by contact at the tube holding elements or by insertion into the associated insertion holes of the tube holding elements.

The inner distribution region of the containers can be divided into two or several regions by the one container comb or also by several container combs. Thereby the pressure stability can be increased and, on the other hand, the wall thicknesses and the container cross-section dimensioned to be a minimum considering the depth of the heat exchanger tubes.

The gaps between the teeth or/and the tooth cross-sectional dimensions, particularly the tooth width, can therefore be configured equally sized or from container to container different along the container comb.

Also several container combs or container double combs, respectively, arranged parallel to each other can be assigned to one container closure element, whereby the container closure element contains the associated insertion hole rows adapted to the teeth. Dependent on the container version the corresponding tube holding elements have adapted insertion hole rows harmonizing with the teeth. Preferably this can be provided in multi-row heat exchangers.

The rows of insertion holes in the tube holding elements and in the container closure elements can preferably be positioned centrally and parallel to the direction of layering of the heat exchanger tubes.

As media passing the heat exchanger tubes, carbon dioxide or other useful gases, liquids, two-phase mixtures, refrigerants above or below the critical temperature or gas mixtures inclusive of additives at higher pressures, can be used.

Further, the problem of the invention is solved by a heat exchanger in that the heat exchanger flat tube is longitudinally slotted between two inner channels preferably half of its length and the distal ends of the heat exchanger tube are put in the tube holding elements in direction of the cylindrical longitudinal axis of the container.

To the concept of this solution, due to the preferable twist of the ends of the flat tube by 90°, a shorter extension of the flat tube ends into the container is reached. Therefore smaller volumes in the container can be realized and there is a lower pressure drop of the flowing heat exchanger fluid or refrigerant. In connection with the reduced inner volume of the container thinner wall thicknesses can be realized. Furthermore, the fluid distribution in the container, which functions as collector and distributor, is improved due to less disturbance sources. Therefore it is possible to utilize smaller quantities of heat exchanger fluid or refrigerant.

Further developments and advantageous embodiments of the invention are described in further sub claims.

BRIEF DESCRIPTION OF THE DRAWINGS

The invention will be explained in detail by means of several examples of embodiment with reference to the drawings. It is shown by:

FIGS. 7*a*–7*b* are a schematic representation of the top view of containers in three further optional versions of the tube holding element and container closure element for an approximately equal design of the container comb similar to FIG. 1;

FIGS. 8*a*–8*b* are, respectively, a cross-sectional top view of a portion of a multi-row heat exchanger, particularly a four-row heat exchanger, inclusive of a container comb for each single container (FIG. 8*a*) and a two-row heat exchanger with a different row container inclusive of two parallel container combs for each single container (FIG. 8*b*);

DETAILED DESCRIPTION

Figure 1:
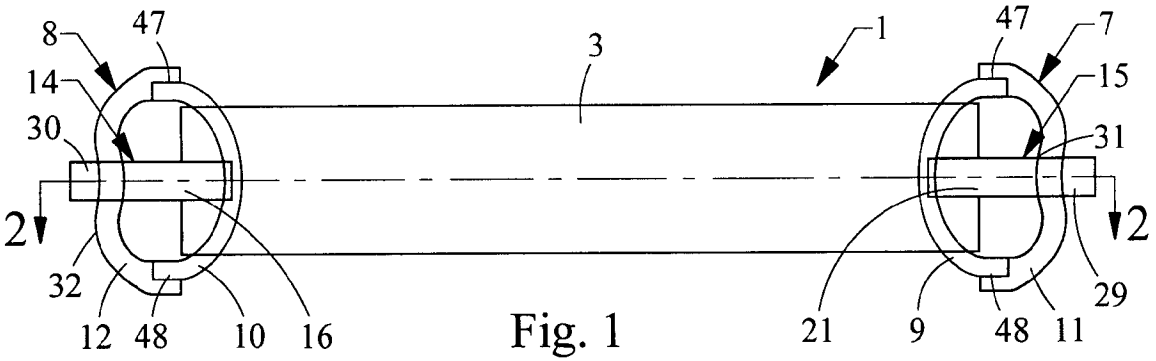
FIG. 1 is a schematic representation of the top view of a heat exchanger embodying the principles of the invention as a cross-sectional view along the line II—II of FIG. 2, whereby the containers of both sides are shown for two different optional versions of the container comb.
Figure 2:
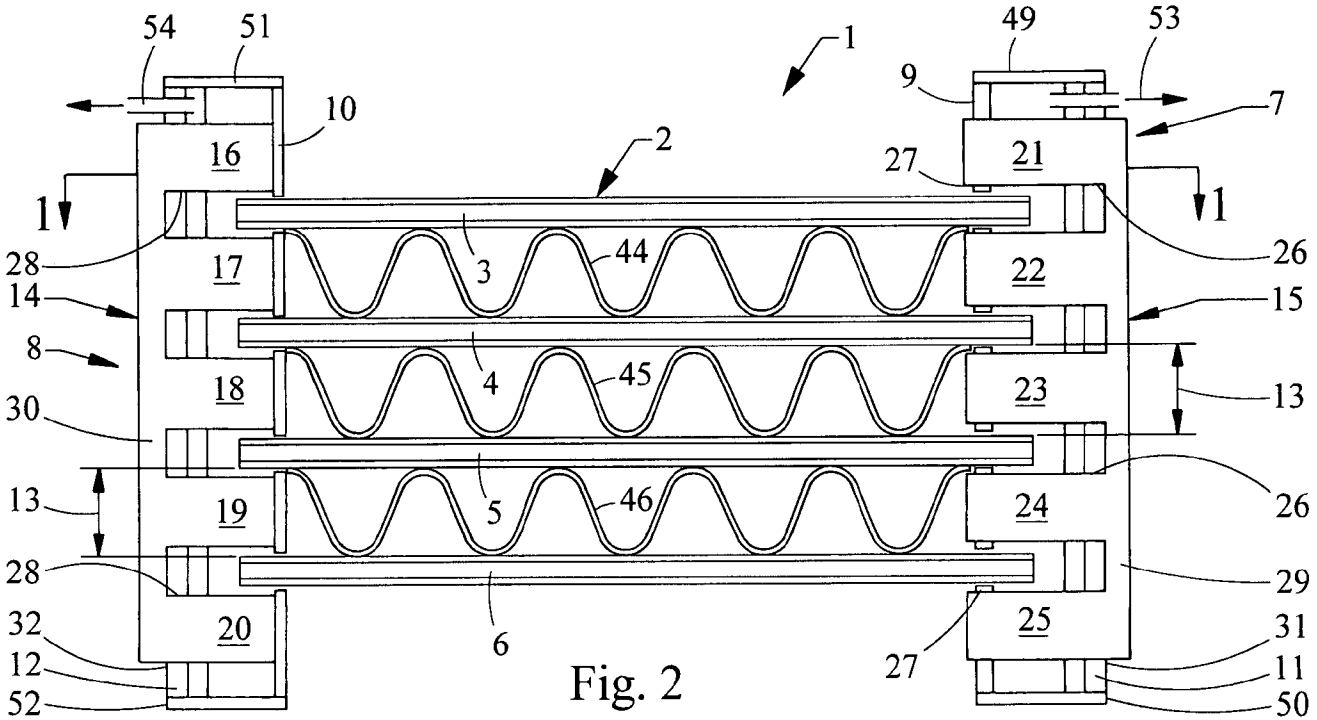
FIG. 2 is a schematic longitudinal sectional view of the heat exchanger along the line I—I of FIG. 1.

Referring now to FIGS. 1 and 2, which are discussed in conjunction with one another, the heat exchanger 1 for vehicles has a heat exchanger core 2 with a row of distanced or spaced heat exchanger tubes 3, 4, 5, 6 open at their ends. Two closed containers 7, 8 are arranged in the tube end regions for the distribution of a medium flowing through the heat exchanger tubes 3, 4, 5, 6, whereby the containers 7, 8 each include a tube holding element 9, 10 and a container closure element 11, 12, which are connected to each other in a sealed manner. The heat exchanger tubes 3, 4, 5, 6 are put through the tube holding element 9, 10 and connected to it defining spaces 13 between each other.

The container closure elements 11, 12 each are rigidly connected to at least one associated container comb 14, 15, the teeth 16 to 20 and 21 to 25 of which are directed towards the heat exchanger core and are put into the container-internal spaces 13 between the heat exchanger tubes 3, 4, 5, 6 and are in rigid connection to at least the tube holding element 9, 10.

The tube holding element 9, 10 can, in its cross-section, preferably be bent semi-elliptically trough-like and with its convex side turned to the put through heat exchanger tubes 3, 4, 5, 6. The container closure element 11, 12, corresponding with the tube holding element 9, 10, can, previous to assembly, i.e. the insertion of the container comb, in its cross-section also be configured approximately semi-elliptically trough-like and with its concave side turned to the heat exchanger tube ends. In the connection sections 47, 48, as shown in FIG. 1, the two elements 9, 11 and 10, 12, respectively, are connected to each other partly butting and/or partly overlapping, forming a sealed, in its cross-section largely elliptical container 7 or 8.

During putting the container comb 14, 15 through the container closure element 11, 12 the original curvature can be changed in the central region of the container closure element 11, 12, which eventually can additionally enhance the stability of the containers 7, 8 and relieve the connection sections 47, 48.

According to the invention, now referring to FIG. 2, in the container closure element 11, 12 there are insertion holes 26, 28 equally distanced and arranged in a row, particularly put-through holes or through openings, through which the teeth 16 to 20 and 21 to 25, respectively, of the container comb 14 or 15, respectively, are put from outside the container closure element 11, 12 into the container closure element 11, 12.

Figure 3:
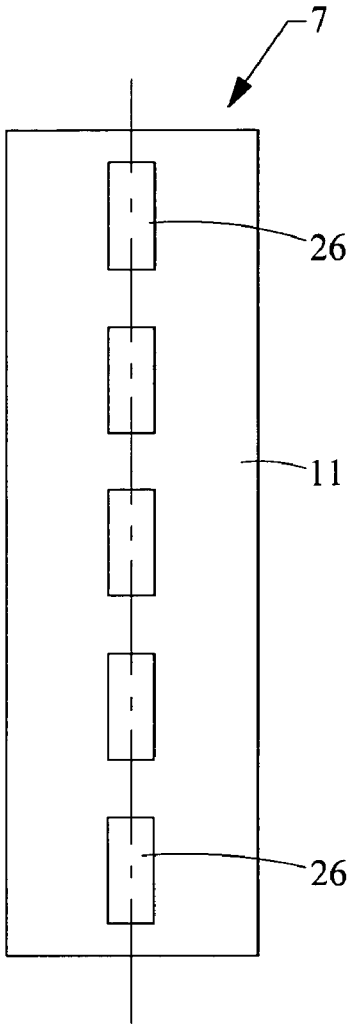
FIG. 3 is a side view of the container closure element with insertion holes, according to FIG. 2, without container comb.

The container combs 14, 15 in the FIGS. 1, 2 are configured such that the comb teeth match with the container closure element 11, 12 put from outside the container closure element 11, 12 through the put-through holes 26 and 28, respectively. In FIG. 3 in a side view of the container closure element 11, the preferably rectangular put-through holes 26, arranged equally distanced in a row, are shown. Also other cross-sections can be configured.

Between the heat exchanger tubes 3, 4, 5, 6, which can preferably be configured as flat tubes, there can be guide plates 44, 45, 46 increasing the surface of the heat exchanger core 2. The heat exchanger tubes 3, 4, 5, 6 themselves can also be designed as plate-shaped multiple-tube packages.

In one version, the first container 7 also has in its tube holding element 9 insertion holes 27, particularly put-through holes or through openings, into which the teeth are pushed until the teeth are approximately flush or flush with the core-directed outer wall surface or project from the outer wall surface of the tube holding element 9. In this way, an intimate link between the first container comb 15, the first container closure element 11 and the first tube holding element 9 is created. The end regions of the comb teeth 21 to 25 projecting from the outer wall can at least be adapted to the second put-through holes 27 preferably by bending, arching, twisting or other mechanical deformation and therefore fix the first tube holding element 9 and the first container closure element 11 as a stable unit before brazing.

Figure 4:
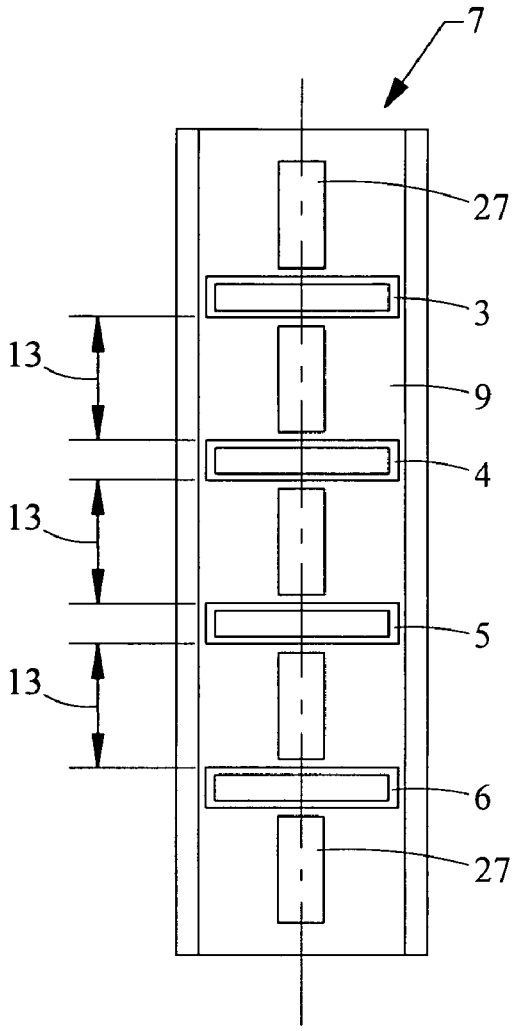
FIG. 4 is a side view of an opened container without a container closure element, but with a tube holding element and heating tubes put-in, according to FIG. 2.

In FIG. 4, an opened container 7 is shown, without the first container closure element 11, but with the first tube holding element 9 and the put-through heat exchanger tubes 3, 4, 5, 6 as well as the second, preferably rectangular put-through holes 27 for the comb teeth 21 to 25, in the spaces 13 between the heat exchanger tubes 3 to 6.

The second container 8 also has in an accompanying second container closure element 12 insertion holes 28, particularly third put-through holes, or through openings, respectively, through which the teeth 16 to 20 of the second container comb 4 are pushed.

The comb ridges 29, 30 are on both container combs 14, 15 outside the containers 7, 8 and bear against the outer wall surfaces 31, 32 of the container closure elements 11, 12. The comb teeth 16 to 20 and 21 to 25, respectively, then are located in the concave regions of the container closure elements 11, 12 and when brazed are locked to the container closure elements 11, 12.

The distribution tube-like containers 7, 8 can be dosed at their faces or ends by cover closures 49, 50 and 51, 52. The heat exchanger 1 can, for example, in the region of the cover closures 49, 51 have an entry 53 in the first container 7 and an exit 54 in the second container 8 for the medium to pass. The cover closures 49 to 52 can also be configured as adapted, bent transition regions between the container closure elements 11, 12 and the tube holding elements 9, 10.

Figure 5:
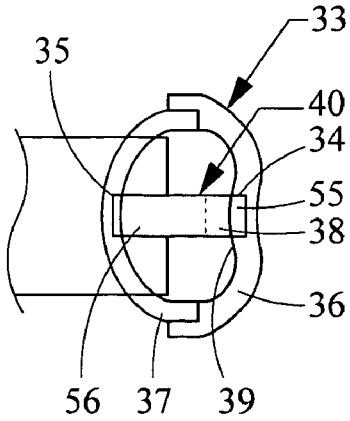
FIG. 5 is a further version of the container with a container double comb in a cross-sectional view similar to FIG. 1.

In FIG. 5, another, third version of a container 33 is shown with insertion holes, particularly put-in holes 34, 35 or bottoming holes in both the third container closure element 36 and the third tube holding element 37, directed from the container inner side in each case. The associated third container comb 40 is a container double comb, on which on both sides of the comb ridge, which is designed in form of a comb batten 38, in direction opposite to the heat exchanger core there are tooth-like projections, which are configured insertable, on the one hand, as short teeth 55 for the first put-in holes 34 of the third container closure element 36 and, on the other hand, as long teeth 56 for the second put-in holes 35 of the third tube holding element 37 and hence fix the third tube holding element 37 and the third container closure element 36. The comb batten 38 associated to the container double comb 40, stabilizing the wall, is preferably on the inner wall surface 39 in the concave region of the third container closure element 36.

Instead of the put-in holes 34, 35 also put-through holes (similar to those of container 7 of FIG. 1) can be provided in both the third container closure element 36 and the third tube holding element 37 for the teeth 55, 56 adapted in each case.

The put-in holes 34, 35 in the tube holding element 37 and the container closure element 36 can be matched to the teeth 55, 56, which can have different heights, widths and lengths concerning each element.

The rows of the insertion holes 26, 27, 28, 34, 35 in the tube holding elements 9, 10, 37 and in the container closure elements 11, 12, 36 are positioned preferably central and parallel to the layering direction of the heating tubes 3, 4, 5, 6.

The container combs 14, 15, 40 of the invention improve both the stability of the containers 7, 8, 33 and the resistance, particularly the coherence against a bursting pressure of the flowing medium acting on the elements given for safety reasons, compared to the known reinforcement measures. At the same time, the wall thicknesses of the associated container elements—the tube holding elements 9, 10, 37 and the container closure elements 11, 12, 36—can be reduced compared to the tube holding element 41 and the container closure element 42 of the known container 43 in FIG. 6*a*, and therefore the container of the invention can be given smaller dimensions, particularly a smaller depth $T_{bc}$ compared to the depth $T_a$.

Figures 6A, 6B, 6C:
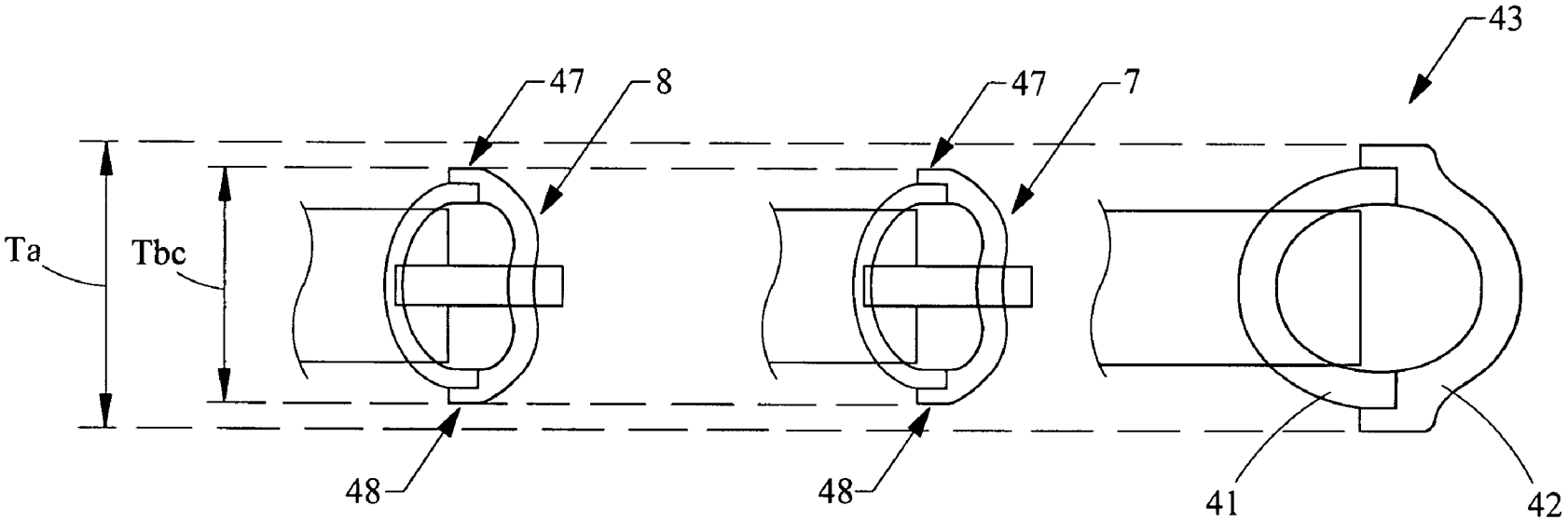
Fig. 6A (Prior Art)
FIGS. 6*a*–6*c* are a comparative representation for the depths of a container of the (a) state-of-the-art and two containers (b and c) in connection with FIG. 1.

In FIG. 6 a comparative representation for the depths of the container 43 of the state-of-the-art to FIG. 6*a* and the two containers 7, 8 of the invention according to FIG. 6*b*, 6*c*, in connection with FIG. 1 is shown. The structure according to the invention of the containers 7, 8 enables one to reduce the total depth of tube holding element/container closure element and the corresponding space required for the heat exchanger 1 installed in the vehicle from the original depth $T_a$=23.4 mm to a new depth $T_{bc}$=18.4 mm, i.e. more than 20% reduction in depth. A similar reduction in depth can be achieved with the container 33 in FIG. 5.

In the following, particularly the method of manufacture of the containers according to the first two embodiments 7, 8 of the invention will be explained in more detail to illustrate the holding comb principle.

A separate container comb 14, 15 is from the convex outside of the container closure element 11, 12 put through the put-through holes 26 or 28, respectively, with its teeth 16 to 20 or 21 to 25, respectively. The container closure element 11, 12 is put onto the tube holding element 9, 10 in the region of the connection sections 47, 48 to connect both elements 9, 11 and 10, 12 to a container 7, 8, which serves as distribution tube for the passing medium. At the same time the comb teeth 21 to 25, in the case of the first container 7, are put through the put-through holes 27 of the tube holding element 9, or in the case of the second container 8, the end regions of the teeth 16 to 20 up to contact with the inner wall of the tube holding element 10. After brazing it can be ensured that a reliable brazing joint between the comb, the rear element—the container closure element 11, 12—and the front element—the tube holding element 9, 10—of each container 7, 8 is reached.

During brazing the brazing material can easily flow into the gaps between the insertion holes 27 and the container comb teeth 21–25. Due to the reduced wall thicknesses the predetermined brazing parameters, particularly the required homogeneous temperature field in the material of all container parts, can be reached in a significantly shorter time.

The container combs 14, 15, 40, the container 33 of the third version included, are with the end faces of the teeth 16 to 20 and 21 to 25 or 56 in positive connection by contact to the tube holding element 10 or by fitting in the associated insertion holes 27, 35 of the tube holding elements 9, 37 via the brazing material in rigid connection.

The inner region of the container 7, 8, 33 is divided into two or several smaller regions by means of the one or also several container combs.

The locked container combs 14, 15 additionally reduce the tensile stresses parallel to the heat exchanger core in the region of the connection sections 47, 48 between the tube holding elements 9, 10 and the container closure elements 11, 12.

For a multiple passage tube heat exchanger there are additional advantages because of the thinner wall thickness of the heat exchanger tubes, whereby among others also the spaces within the tube rows can be reduced. This results in a better efficiency of the guide plates between the tube rows, because the thermal transition paths can be shortened and additionally, the depth of the active heat exchanger core can be reduced.

The invention also makes possible to influence the distribution of the flowing medium within the heat exchanger, if the gaps between the teeth or/and the tooth width are dimensioned different over the length of the container comb. This will lead to a better temperature distribution of the flowing medium on the outside of the heat exchanger tubes, for example, with reference to the heat-absorbing air passing the heat exchanger core.

The heat exchanger tubes of the heat exchanger core are put through the other put-through holes of the tube holding element, which are assigned to the heat exchanger tubes, and can end with the tube ends between the gaps of the comb teeth.

The medium passing the heat exchanger tubes, for example, a gas/liquid mixture (two-phase mixture) or a gas or a refrigerant in the region above the critical temperature, is directed towards the regions of the cross-section divided by the comb. For a multiple passage tube heat exchanger this structure concerning the container comb can also be used.

It is also possible to influence the distribution of the flowing medium within the heat exchanger 1, if the gaps between the comb teeth 16 to 20 and 21 to 25 are dimensioned different over the length. This will lead to a better heat transition.

In FIGS. 7*a*–7*c*, particularly concerning the special configuration of the connection sections between a tube holding element and a container closure element, a schematic representation of the cross-sectional top view of three other containers 57, 58, 59 is shown for three optional versions for an approximately equal design of a container comb similar to FIG. 1. In the FIGS. 7*a*, 7*b*, 7*c* it is shown that, due to the container comb support, the connection sections 61, 62 between a tube holding element 63 designed in various manners and a 3-shaped container closure element 64 can be configured different, either butting—FIG. 7*a*—and/or overlapping on the outside—FIG. 7*b*—or overlapping on the inside—FIG. 7*c*. Further, a projection-like reinforcement 65 nose-shaped in its cross-section supports in the central region of the container closure element inner wall the cross-sectional 3-shaped configuration and hence the improvement of the stability of the containers 57, 58, 59. In addition, the tube holding element 63 can also in its cross-section be designed rectangular or slightly convex in direction of the heat exchanger tubes 3.

FIG. 1 and FIGS. 7*a* to 7*c* show that the cross-sectional shapes of the tube holding element 9, 10, 63 and the container closure element 11, 12, 64 can correspond with each other. The tube holding element 63 can also be curved convex in direction of the heat exchanger tubes 3 and the container closure element 64 can have in its cross-section a rectangular or slightly concave shape.

A cross-sectional top view a portion of a multi-row heat exchanger, particularly a four-row heat exchanger 66—in FIG. 8*a*—and a two-row heat exchanger 67—in FIG. 8*b*—with row containers 68, 69 with one container comb 70 in each case or with two parallel container combs 71, 72 in each case, is shown. The row containers 68, 69 can be provided two-sidedly, at both the opposite sides of the associated heat exchanger tubes 73, 74. If no opposite row container is provided, the heat exchanger tubes 73, or 74, respectively, can be bent to be brought together on that side where there is no container.

In FIG. 8*a* the row container closure element 75 contains, in each case, a container comb 70 in a single container of the first row container 68. The container comb 70 is held in a tube holding element 76 rectangular in its cross-section.

Instead of one container comb 70, the parallel container combs 71, 72 can be assigned to the row container closure element 75 related to a single container in the second row container 69, as shown in FIG. 8*b*. The row container closure element 75 and the opposite, in its cross-section rectangular, on the outside overlapping tube holding element 76 then also contain the associated insertion hole rows.

As has been explained in detail, different cross-sectional shapes of the tube holding element and the container closure element are possible. It is relevant for the invention that the container are held together in an improved way due to the shape-adapted container combs.

Due to the considerably improved container strength, the invention ensures the possibility that also heat absorbing and/or heat dissipating media with high passing pressures, which can be developed in future, can be provided for the heat exchangers 1, 57, 58, 59, 66, 67 of the invention.

Also, the specified bursting pressure can be chosen higher, whereby the heat carrying flowing medium, particularly carbon dioxide or other useful gases or gas mixtures inclusive of additives can be used at higher pressures compared to traditional liquid media.

Figure 9:
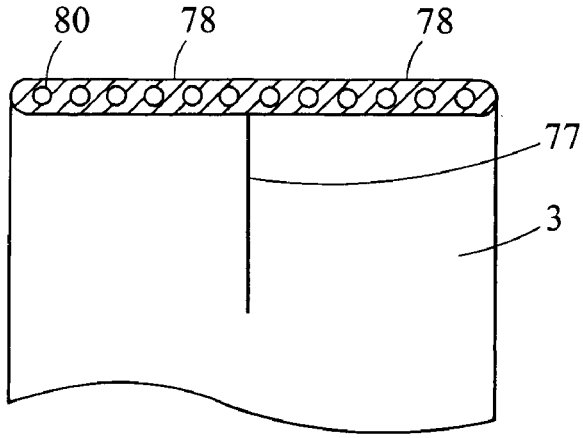
FIG. 9 is a heat exchanger flat tube with slit.
Figure 10:
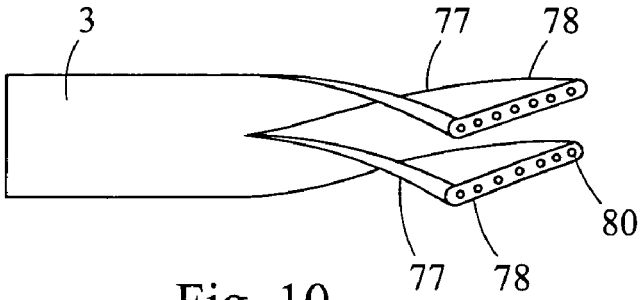
FIG. 10 is a heat exchanger flat tube slotted half of its length, with twisted flat tube ends.
Figure 11:
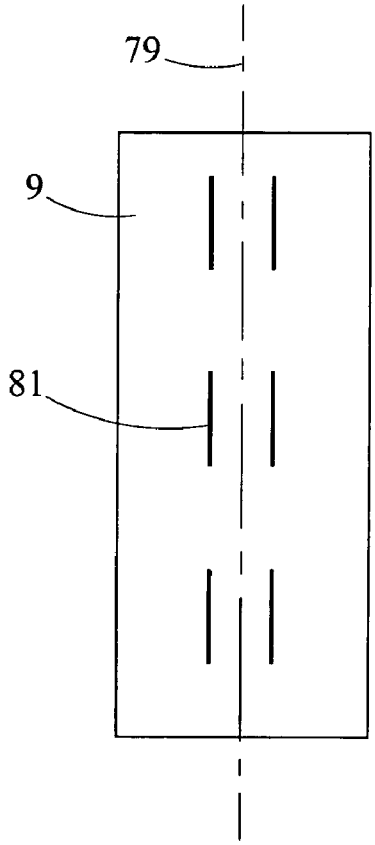
FIG. 11 is a tube holding element with parallel slits.

In FIGS. 9 to 11 another alternative embodiment of the invention is shown in detail.

According to the invention the heat exchanger for vehicles also is provided with a heat exchanger core, which has a row of distanced heat exchanger tubes open at the end and at least one dosed container arranged in the end regions for the distribution of a medium flowing in the heat exchanger tubes, whereby the containers preferably include a tube holding element 9 and a container closure element, which are connected to each other at connection sections in a sealed manner, and whereby the heat exchanger tubes are put through the tube holding element 9 and connected to it forming spaces between each other.

Also included in the principle of the invention, tubes or tubes welded or formed of flat material braze-plated one- or two-sidedly can be used as containers.

The peculiarity of this solution is that the heat exchanger tubes 3 are formed as flat tubes with channels 80, whereby the flat tubes are provided with a cut 77 in longitudinal direction between two channels 80 and the developing flat tube ends 78 are twisted such that the flat tube ends 78 of a heat exchanger flat tube in longitudinal direction of a container along a cylinder generatrix of the tube holding element 9 are put through a slit 81 and connected to the tube holding element 9.

Particularly preferably, the heat exchanger tubes 3 are divided by a cut half of their lengths, but also divisions being not half of the lengths of the heat exchanger tubes 3 are possible. The flat tube ends 78 generated in this way are preferably twisted by 90°. The slits 81 in the tube holding element 9 for the flat tube ends 78 are distanced parallel to each other and positioned adapted to the respective layers of the flat tubes of the heat exchanger core.

According to an advantageous embodiment of the invention several cuts 77 are made at the heat exchanger flat tube end so that several flat tube ends 78 are generated and the single layers, or dimensions of the slit lengths in the tube holding element 9 become smaller.

Further the invention opens up the possibility to significantly reduce the wall thicknesses of the tube holding element and the container closure element compared with the known heat exchangers. Thus also the dimensions and the weight of the containers can be considerably reduced. This results in saving material and processing costs.

The invention claimed is:

1. Heat exchanger for vehicles comprising a heat exchanger core with a row of distanced heat exchanger tubes open at their ends, at least one closed container arranged at the ends of the heat exchanger tubes for the distribution of a medium flowing through the heat exchanger tubes, each container includes a tube holding element and a container closure element being connected to each other in a sealed manner at connection sections, the heat exchanger tubes being put through the tube holding element and being connected to it so as to form spaces between each, the container closure element being rigidly connected to at least one associated container comb having a batten along a wall of the container closure element having insertion holes having teeth directed towards the heat exchanger core and located in the spaces between the heat exchanger tubes and in rigid connection to at least the tube holding element.

2. The heat exchanger of claim 1 wherein the tube holding element is in its cross-section is a semi-elliptical trough with its convex side turned toward the heat exchanger tubes, the container closure element corresponding with the tube holding element is in its cross-section semi-elliptical trough and with its concave side turned toward the heat exchanger tubes so that the container in its cross-section has a generally elliptical shape.

3. The heat exchanger of claim 1 wherein the tube holding element in its cross-section is preferably rectangular.

4. The heat exchanger of claim 1 wherein the tube holding element and the container closure element are connected to each other in the connection sections in a butting engagement.

5. The heat exchanger of claim 1 wherein the tube holding element and the container closure element are connected to each other in the connection sections in an overlapping inside engagement.

6. The heat exchanger of claim 1 wherein the tube holding element and the container closure element are connected to each other in the connection sections in an overlapping outside engagement.

7. The heat exchanger of claim 1 wherein the teeth contact the inner wall of the tube holding element with their end faces.

8. The heat exchanger of claim 1 wherein the tube holding element is provided with put-through holes into which the teeth are put.

9. The heat exchanger of claim 8 wherein the ends of the teeth are generally flush with an outer wall surface of the tube holding element toward the core, whereby an intimate link between the comb, the container closure element and the tube holding element is formed.

10. The heat exchanger of claim 1 wherein the tube holding element is provided with put-in holes directed from the interior of the container and in which the ends of the teeth of the comb are put.

11. The heat exchanger of claim 1 wherein the container is provided with additional insertion holes in the tube holding element the container comb is a double comb having a batten bearing against a container inner wall surface of the container closure element.

12. The heat exchanger of claim 11 wherein the double comb includes teeth on both sides of the comb batten, the teeth being configured on one side as short teeth and on the other side as long teeth.

13. The heat exchanger of claim 11 wherein the insertion holes are one of put-in holes and put-through holes.

14. The heat exchanger of claim 1 wherein the tube holding elements and the container closure elements include insertion holes adapted to the teeth having varying heights, widths and lengths.

15. The heat exchanger of claim 1 wherein the container comb is in positive connection at end faces of the teeth by contact with the tube holding elements via brazing material.

16. The heat exchanger of claim 1 wherein an inner distribution region of the container for a flowing medium is divided into more than one region by the container comb.

17. The heat exchanger of claim 1 wherein gaps between the teeth varies along the container comb.

18. The heat exchanger of claim 1 wherein tooth cross-sectional dimensions vary along the container comb.

19. The heat exchanger of claim 1 wherein more than one container comb is arranged parallel to each other within one container closure element.

20. The heat exchanger of claim 1 wherein insertion holes are formed in the container closure element and are positioned central and parallel to the direction of layering of the heat exchanger tubes.

21. The heat exchanger of claim 1 wherein the container closure element is essentially "3"-shaped in cross-section.

22. The heat exchanger of claim 1 wherein there is a projection-like nose-shaped reinforcement in the region of the central portion of the container closure element inner wall.

23. The heat exchanger of claim 1 wherein the tube holding element in cross-section is rectangular.

24. The heat exchanger of claim 1 wherein the tube holding element in cross-section is slightly convex towards the heat exchanger tubes.

25. The heat exchanger of claim 1 designed as a multi-row heat exchanger, is provided with row containers which have at least one container comb each.

26. The heat exchanger of claim 25 wherein the row containers are provided on both opposite sides of the associated heat exchanger tubes.

27. The heat exchanger of claim 1 wherein between the heat exchanger tubes there are guide plates increasing the surface of the heat exchanger core.

28. The heat exchanger of claim 1 wherein the heat exchanger tubes are configured plate-shaped multiple-tube packages.

29. The heat exchanger of claim 1 wherein the containers are closed at their ends by cover closures.

30. The heat exchanger of claim 29 wherein the cover closures are configured as bent transition regions between the container closure elements and the tube holding elements.

31. The heat exchanger of claim 1 further comprising carbon dioxide as the passing medium.

32. Heat exchanger for vehicles comprising a heat exchanger core with a row of distanced heat exchanger tubes open at their ends, at least one closed container arranged at the ends of the heat exchanger tubes for the distribution of a medium flowing through the heat exchanger tubes, each container includes a tube holding element and a container closure element being connected to each other in a sealed manner at connection sections, the heat exchanger tubes being put through the tube holding element and being connected to it so as to form spaces between each, the container closure element being rigidly connected to at least one associated container comb having a batten along a wall of the container closure element having insertion holes having teeth directed towards the heat exchanger core and located in the spaces between the heat exchanger tubes and in rigid connection to at least the tube holding element, the tube holding element being provided with put-through holes through which the teeth are put, the ends of the teeth projecting from an outer wall surface of the tube holding element and being deformed such that the tube holding element, the container comb and the container closure element are prefixed as a stable unit prior to the brazing process.

33. Heat exchanger for vehicles comprising a heat exchanger core with a row of distanced heat exchanger tubes open at their ends, at least one closed container arranged at the ends of the heat exchanger tubes for the distribution of a medium flowing through the heat exchanger tubes, each container includes a tube holding element and a container closure element being connected to each other in a sealed manner at connection sections, the heat exchanger tubes being put through the tube holding element and being connected to it so as to form spaces between each, the container closure element being rigidly connected to at least one associated container comb having a batten along a wall of the container closure element having insertion holes having teeth directed towards the heat exchanger core and located in the spaces between the heat exchanger tubes and in rigid connection to at least the tube holding element, the batten of the container comb being located outside the container and bearing against an outer wall surface of the container closure element such that the teeth are on an opposite side of the container closure element.

* * * * *

UNITED STATES PATENT AND TRADEMARK OFFICE

CERTIFICATE OF CORRECTION

PATENT NO. : 7,152,668 B2
APPLICATION NO. : 11/031665
DATED : December 26, 2006
INVENTOR(S) : Hanskarl Hoffmann et al.

It is certified that error appears in the above-identified patent and that said Letters Patent is hereby corrected as shown below:

On the Title Page, item [30]

In column 1, line 1, under "Foreign Application Priority Data" delete "252" and substitute --252.6-- in its place.

In column 2, line 4, under "ABSTRACT" delete "dosed" and substitute --closed-- in its place.

Column 12, in claim 2, line 2, after "element" delete "is".

Column 14, in claim 30, line 1, after "of claim" delete "29" and substitute --28-- in its place.

Signed and Sealed this

Third Day of April, 2007

JON W. DUDAS
*Director of the United States Patent and Trademark Office*